US005707251A

United States Patent [19]

Sakai et al.

[11] Patent Number: 5,707,251

[45] Date of Patent: Jan. 13, 1998

[54] WATERPROOF STOPPER FOR WATERPROOF CONNECTORS

[75] Inventors: Hitoshi Sakai; Hitoshi Saito, both of Haibara-gun, Japan

[73] Assignee: Yazaki Corporation, Tokyo, Japan

[21] Appl. No.: 805,319

[22] Filed: Feb. 24, 1997

Related U.S. Application Data

[63] Continuation of Ser. No. 397,495, Mar. 2, 1995, abandoned.

[30] Foreign Application Priority Data

Mar. 3, 1994 [JP] Japan ..... 6-033317

[51] Int. Cl.[6] ..... H01R 13/52

[52] U.S. Cl. ..... 439/589; 439/274

[58] Field of Search ..... 439/271–283, 439/586, 587, 589, 701, 595, 597

[56] References Cited

U.S. PATENT DOCUMENTS

| | | | |
|---|---|---|---|
| 4,214,802 | 7/1980 | Otani et al. | 439/275 |
| 4,944,688 | 7/1990 | Lundergan | 439/595 |
| 4,998,896 | 3/1991 | Lundergan | 439/279 |
| 5,116,236 | 5/1992 | Colleran et al. | 439/271 |

FOREIGN PATENT DOCUMENTS 3-122979 5/1991 Japan .

*Primary Examiner*—Hien Vu

*Attorney, Agent, or Firm*—Armstrong, Westerman, Hattori, McLeland & Naughton

[57] ABSTRACT

A blocking plug is reliably locked in position in an insertion hole in a waterproof stopper and prevented from slipping off. A rubber-made waterproof stopper is fitted in the rear of a waterproof connector housing with a plurality of terminal accommodating chambers formed therein, the waterproof stopper having insertion holes corresponding to the individual terminal accommodating chambers. A stopper cover of synthetic resin having throughholes corresponding to the individual insertion holes of the waterproof stopper is provided to cover the waterproof stopper. The stopper cover is in the rear surface formed with engagement portions each for engagement with a corresponding engagement portion formed at the rear of a blocking plug. When a blocking plug is thrusted into the holes of the stopper cover and the waterproof stopper corresponding to a terminal accommodating chamber not used to accommodate a terminal, the engagement portion of the blocking plug is engaged with the corresponding engagement portion in the rear surface of the stopper cover to lock the blocking plug in position.

5 Claims, 3 Drawing Sheets

WATERPROOF STOPPER FOR WATERPROOF CONNECTORS

This application is a continuation of application Ser. No. 08/397,495 filed Mar. 2, 1995, now abandoned.

BACKGROUND OF THE INVENTION

1. Field of the Invention

This invention relates to a waterproof stopper for use with waterproof connectors used to connect automotive wiring harnesses and the like.

2. Description of the Related Art

FIG. 4 shows a conventional waterproof stopper. In this figure, a waterproof stopper of rubber is fitted in an open chamber b at the rear of a connector housing a. The waterproof stopper c is formed with insertion holes e, each corresponding to a related terminal accommodating chamber d in the connector housing a and surrounded by annular sealing ribs e1.

A terminal lug g attached in advance to a wire f is passed through an insertion hole e while deforming the related annular ribs e1 until the lug g is locked in position in the terminal accommodating chamber d by a resilient locking piece h. After passage of the terminal lug g, the annular ribs e1 return to their original position and pressure-contact an outer periphery of the wire f to give sealing performance.

Into the upper insertion hole e in FIG. 4 corresponding to the not-used terminal accommodating chamber d, a synthetic-resin made blocking plug i is fitted to bring its outer engagement projections i1 into engagement with the annular ribs e1, thereby securing sealing of the insertion hole e.

With this construction, however, since the engagement-making annular ribs e1 of the waterproof stopper c are of a soft structure, it is possible that the blocking plug i is thrusted in to an over extent or slipped off by an external force. A further drawback is that, since the engagement is made inside the waterproof stopper c, it is impossible to tell from outside whether the engagement is sound.

FIG. 5 shows another conventional waterproof stopper. In this figure, a waterproof stopper j and a synthetic-resin made stopper cover k provided in face-to-face relation to the rear of the waterproof stopper j are shown. The water-proof stopper j is formed with insertion holes j1 and the stopper cover k with throughholes k1, each in alignment with a related insertion hole j1. An insertion-hole blocking plug l is integrally provided so as to project from the front of each throughhole k1 and is removed when unnecessary as a removed plug l'.

In this case, however, if one blocking plug l is removed in error at the time of removing a selected blocking plug or plugs, it will cause the stopper cover k to become of no use at all. This may also be caused when a blocking plug l is damaged by an external force during transportation and the like. Further, the larger the number of terminal accommodating chambers that are used to accommodate terminals, the larger the number of blocking plugs l must be removed, resulting in additional work and waste of material.

SUMMARY OF THE INVENTION

This invention has been accomplished to overcome the above drawbacks and an object of this invention is to provide a waterproof stopper in which an independent insertion-hole blocking plug is used and securely locked so as not to be slipped off.

In order to attain the above object, according to this invention, there is provided a waterproof structure for waterproof connectors comprising a connector housing with terminal accommodating chambers formed therein; a waterproof stopper fitted in a rear portion of the connector housing and having terminal insertion holes therethrough corresponding to the individual terminal accommodating chambers; a stopper cover provided so as to cover the waterproof stopper and having throughholes corresponding to the individual terminal insertion holes of the waterproof stopper, the stopper cover further having engagement portions at positions adjacent to the individual throughholes; and at least one blocking plug comprising a main portion inserted into a throughhole and the associated terminal insertion hole to seal the terminal insertion hole and an engagement portion for engagement with the associated engagement portion in the stopper cover when the main portion is inserted into the throughhole and the associated terminal insertion hole.

In the above waterproof structure, the engagement portion of the insertion-hole blocking plug is engaged with the engagement portion formed in the stopper cover so that the blocking plug is reliably locked in position.

The above and other objects, features and advantages of this invention will become apparent from the following description and the appended claims, taken in conjunction with the accompanying drawings.

DESCRIPTION OF THE PREFERRED EMBODIMENT

Figure 1:
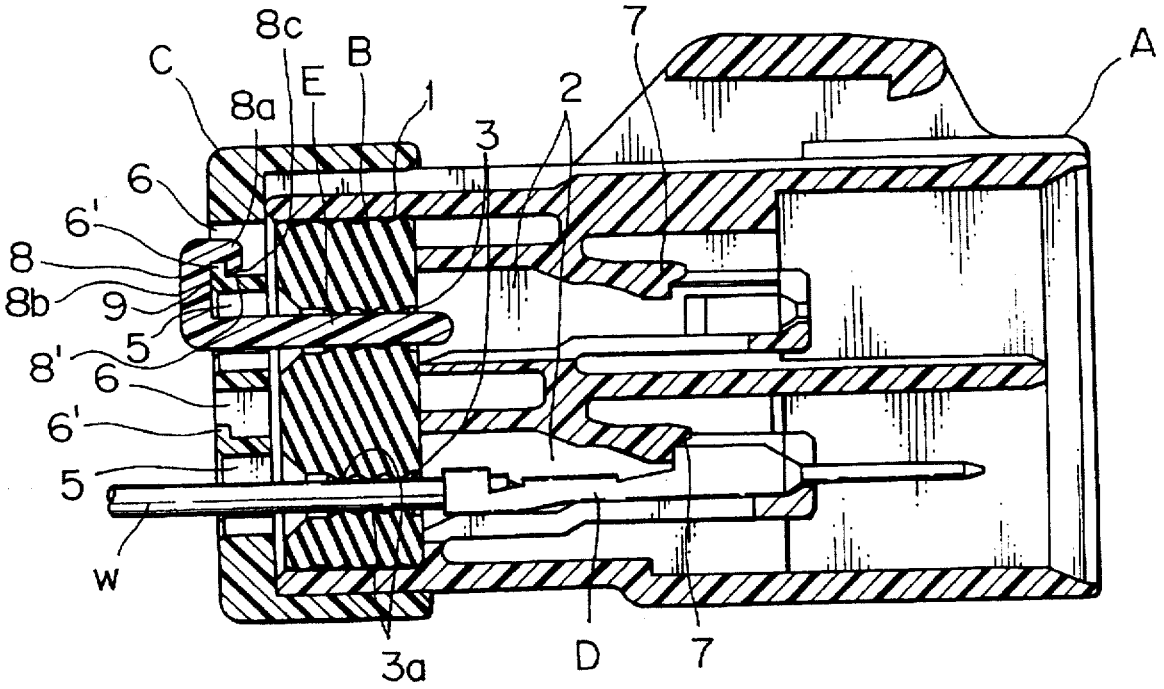
FIG. 1 is a sectional view of a waterproof structure according to one embodiment of this invention.
Figure 2:
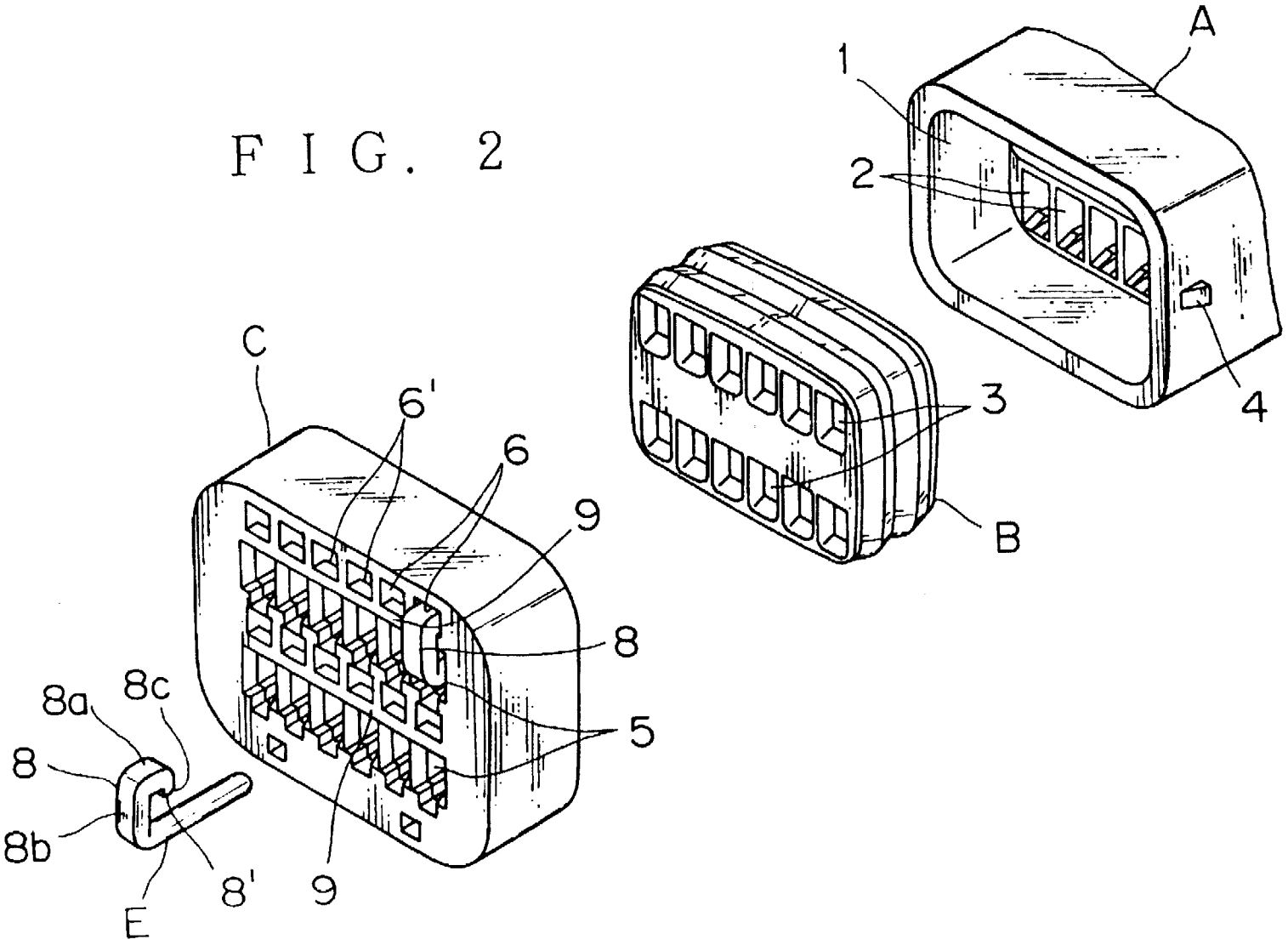
FIG. 2 is an exploded perspective view of an essential portion of the waterproof structure in FIG. 1.
Figure 4:
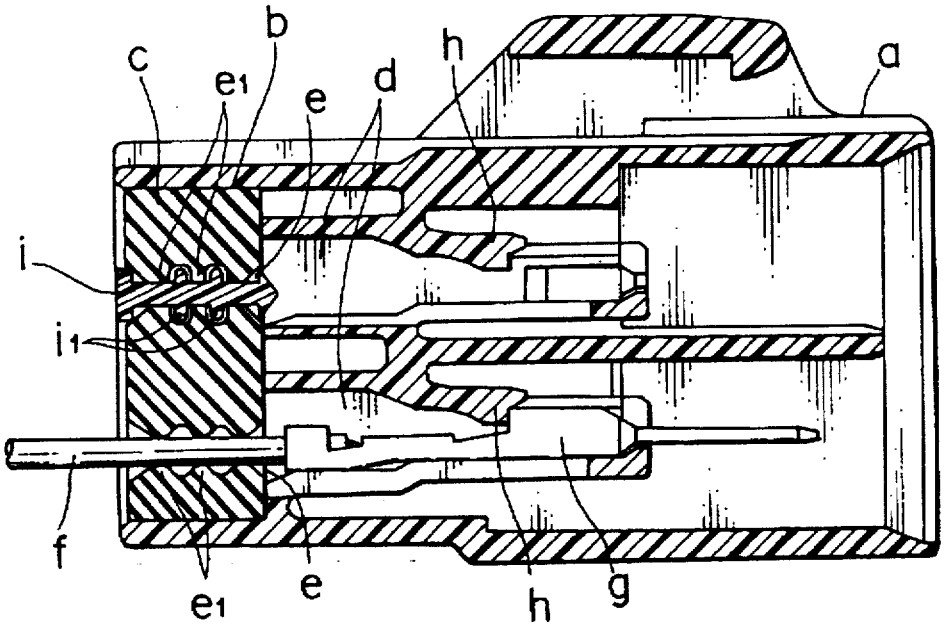
FIG. 4 PRIOR ART
FIG. 4 is a sectional view of a conventional waterproof structure.
Figure 5:
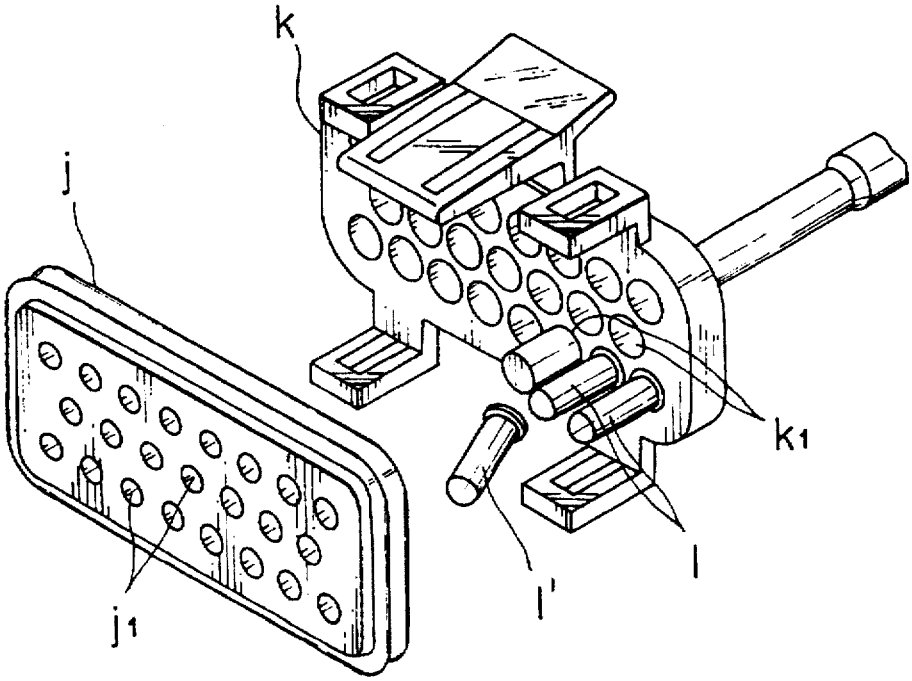
FIG. 5 PRIOR ART
FIG. 5 is a perspective view of another conventional waterproof structure.

Referring to FIGS. 1 and 2, in an open chamber 1 at the rear of a synthetic-resin made connector housing A is fitted a rubber-made plate-like waterproof stopper B which is formed with insertion holes 3, each corresponding to an associated terminal accommodating chamber 2 in the connector housing A and surrounded by annular sealing ribs 3*a*.

A cap-like stopper cover C is fitted over the rear end of the connector housing A and locked to the housing by engagement with an engagement projection 4 (FIG. 2). The stopper cover C is formed with throughholes 5 each in alignment with an associated insertion hole 3 of the waterproof stopper B. The stopper cover C is further, in the rear surface 9 at positions close adjacent to and above the individual insertion holes 5, formed with engagement holes 6 each with an engagement portion 6' formed therein.

With the construction as mentioned above, a terminal lug D attached in advance to a wire W is passed, while deforming the annular sealing ribs 3*a*, through a throughhole 5 of the stopper cover C and the associated insertion hole 3 of the waterproof stopper B until the terminal lug D is locked in position in the terminal accommodating chamber 2 by a resilient locking piece 7. After passage of the terminal lug D, the annular ribs 3*a* return to their original position to pressure-contact an outer periphery of the wire W and give sealing performance.

A synthetic-resin insertion-hole blocking plug E is inserted through the upper throughhole 5 and through insertion hole 3 as seen in FIG. 1, in which blocking plug E is inserted into hole 3 which corresponds to the terminal accommodating chamber 2 not used to accommodate a terminal. The blocking plug E comprises a straight portion to be inserted through the throughhole 5 and through the insertion hole 3. A bent portion 8 is disposed at the rear end of the straight portion, so as to generally form a U-shaped configuration. The bent portion 8 comprises a turn-back portion 8*a* substantially parallel to the straight portion and having at the front end an inwardly directed engagement portion 8', and a joint portion 8*b* that integrally joins the turn-back portion 8*a* to the straight portion. When the joint portion 8*b* of a blocking plug E is in contact with the rear surface 9 of the stopper cover C at a position between a throughhole 5 and the associated engagement hole 6 with the straight portion thrusted into through hole 5 and insertion hole 3, the engagement portion 8' of the blocking plug E engages the corresponding engagement portion 6' in the engagement hole 6 to reliably lock the blocking plug E in position. The engagement portion 8' of the blocking plug E is cut at the front end to form a curved guide surface 8*c* for facilitating the insertion of the engagement portion 8' into the engagement hole 6 by alloying easy slippage of engagement portion 8' over engagement portion 6' during engagement.

Figure 3:
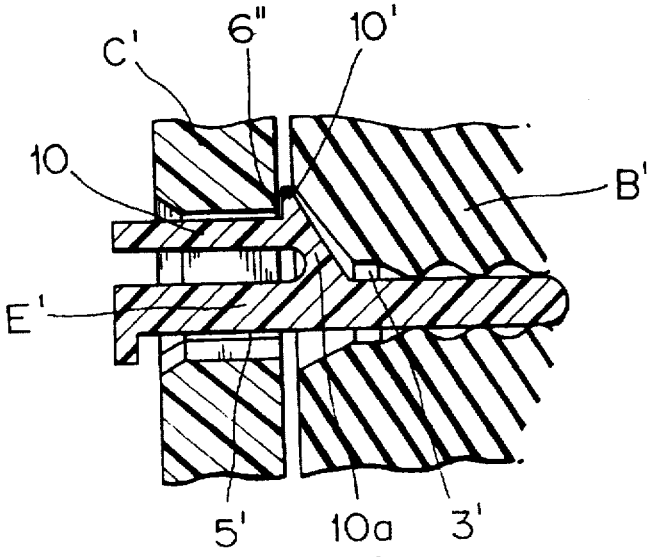
FIG. 3 is a sectional view of an essential portion of a waterproof structure according to another embodiment of this invention.

Referring to FIG. 3, a blocking plug E', according to anther embodiment of this invention, is shown which comprises a main straight portion and a resilient locking portion 10 that extends upwardly at a rear base portion 10*a* and then rearwardly. The locking portion 10 is formed with a radially extended engagement portion 10'. When the main straight portion is fitted into the throughhole 5' of the stopper cover C' and the insertion hole 3' of the rubber-made waterproof stopper B', the engagement portion 10' of the resilient locking portion 10 engages an engagement portion 6" at the circumferential edge of the throughhole 5' to securely lock the blocking plug E' in position.

Thus, with the construction of this invention as described above, a blocking plug is reliably prevented from slipping out of an insertion hole in the waterproof stopper. Further, since the engagement portions can be seen from the outside, locking of a blocking plug is checked with ease by the operator.

What is claimed is:

1. A waterproof structure for electrical waterproof connectors comprising:

a connector housing having a rear portion and terminal accommodating chambers formed therein;

a waterproof stopper fitted in said rear portion of said connector housing and having terminal insertion holes therethrough corresponding to said individual terminal accommodating chambers;

a stopper cover for covering said waterproof stopper and having a rear surface and throughholes corresponding to said individual terminal insertion holes of said waterproof stopper, said stopper cover further having engagement portion each disposed adjacent to each of said individual throughholes; and at least one generally J-shaped blocking plug formed separately from said stopper cover, including a main straight portion and a bent portion integral with said main straight portion at a proximal end of said blocking plug, wherein an inwardly elongated engagement portion is formed at a proximal end of said bent portion, wherein said main straight portion is insertable into said throughhole of said stopper cover and said corresponding terminal insertion hole of said waterproof stopper, with said bent portion of said blocking plug being hooked with said engagement portion of said stopper cover when said stopper cover is in position to cover said waterproof stopper, thereby preventing said blocking plug in said terminal insertion hole from falling out and enabling said terminal insertion hole to be sealed said blocking plug to seal the insertion hole and further to be reused when said blocking plug is removed from the insertion hole.

2. A waterproof structure according to claim 1, wherein said stopper cover also includes an engagement hole formed, adjacent to each of said throughholes, wherein each of said engagement portions of said stopper cover is integrally formed with a corresponding one of said engagement holes while said inwardly elongated engagement portion of each blocking plug is inserted into a corresponding one of said engagement holes of said stopper cover.

3. A waterproof structure according to claim 2, wherein said bent portion comprises a turn-back portion and a joint portion that joins said turn-back portion to said main straight portion, and said inwardly elongated engagement portion of said blocking plug is located at said turn-back portion such that, when said main straight portion of said blocking plug is inserted into said throughhole of said stopper cover and said terminal insertion hole of said waterproof stopper, a back surface of said joint portion contacts said rear surface of said stopper cover extending from said throughhole to said engagement hole of said stopper cover, thereby engaging said inwardly elongated engagement portion of said blocking plug to said engagement portion of said engagement hole of said stopper cover.

4. A waterproof structure according to claim 3, wherein said inwardly elongated engagement portion of said blocking plug is formed as a curved guide surface for facilitating insertion of said inwardly elongated engagement portion into said engagement hole of said stopper cover.

5. A waterproof structure according to claim 2, wherein said throughholes of said stopper cover are provided in a plurality of rows and said engagement holes of said stopper cover are provided in a corresponding number of rows.

* * * * *